US008585181B2

(12) United States Patent
Miyakoshi

(10) Patent No.: US 8,585,181 B2
(45) Date of Patent: Nov. 19, 2013

(54) INKJET HEAD AND ELECTROSTATIC ATTRACTION TYPE INKJET HEAD

(75) Inventor: Hiroshi Miyakoshi, Higashikurume (JP)

(73) Assignee: Konica Minolta Holdings, Inc., Tokyo (JP)

( * ) Notice: Subject to any disclaimer, the term of this patent is extended or adjusted under 35 U.S.C. 154(b) by 432 days.

(21) Appl. No.: 12/745,750

(22) PCT Filed: Oct. 30, 2008

(86) PCT No.: PCT/JP2008/069752

§ 371 (c)(1),
(2), (4) Date: Jun. 2, 2010

(87) PCT Pub. No.: WO2009/075147

PCT Pub. Date: Jun. 18, 2009

(65) Prior Publication Data

US 2010/0259582 A1 Oct. 14, 2010

(30) Foreign Application Priority Data

Dec. 10, 2007 (JP) ..... 2007-318818

(51) Int. Cl.
*B41J 2/14* (2006.01)
*B41J 2/045* (2006.01)

(52) U.S. Cl.
USPC ..... 347/47; 347/68

(58) Field of Classification Search
USPC ..... 347/48
See application file for complete search history.

(56) References Cited

U.S. PATENT DOCUMENTS

| | | | | |
|---|---|---|---|---|
| 6,168,263 | B1 * | 1/2001 | Nojima et al. | 347/54 |
| 6,554,408 | B1 * | 4/2003 | Miki et al. | 347/70 |
| 6,752,490 | B2 * | 6/2004 | Pickrell | 347/68 |
| 6,851,187 | B2 * | 2/2005 | Kishima | 29/890.1 |

FOREIGN PATENT DOCUMENTS

| | | | |
|---|---|---|---|
| JP | 05-024193 | A | 2/1993 |
| JP | 05-229128 | A | 9/1993 |
| JP | 09-254431 | A | 9/1997 |
| JP | 2003-127359 | A | 5/2003 |
| JP | 2007-111957 | A | 5/2007 |

OTHER PUBLICATIONS

Wikipedia Article: Glass, Introduction: Paragraph 1.*

* cited by examiner

*Primary Examiner* — Lisa M Solomon
(74) *Attorney, Agent, or Firm* — Holtz, Holtz, Goodman & Chick, PC

(57) ABSTRACT

The inkjet head has a first silicon substrate 10 having ink ejection ports 11 formed, a glass substrate 20 bonded to the first silicon substrate 10, having ink channel holes 21 formed thereon, and a second silicon substrate 30 having ink chambers 31 grooved, piezoelectric elements 35 provided on the back side of the ink chambers 31 and the ink chamber forming surface bonded to the glass substrates 20. In the second silicon substrate 30, there are formed an ink flow channel 32 communicating with the ink chambers 31 and through holes 34 communicating with the ink flow channel 32 on the ink chamber forming surface, wherein an ink circulation tubes 50 made of glass tubes are bonded to the through holes 34, and the first silicon substrate 10, the glass substrate 20, the second silicon substrate 30 and an bonding surface of the ink circulation tube are anodically-bonded.

11 Claims, 4 Drawing Sheets

INKJET HEAD AND ELECTROSTATIC ATTRACTION TYPE INKJET HEAD

This application is the United States national phase application of International Application PCT/JP2008/069752 filed Oct. 30, 2008.

FIELD OF THE INVENTION

The present invention relates to an inkjet head and an electrostatic attraction type inkjet head in particular to an inkjet head and an electrostatic attraction type inkjet head configured without using an adhesive, which is less resistible for ink.

PRIOR ART

In an on-demand type inkjet recording apparatus, by applying ejection energy to ink in ink chambers selectively, an ink droplet is ejected from a minute nozzle and landed onto an object. Since the inkjet recording apparatus can perform a very fine recording, besides the image printing field, it has been adapted to production technology fields of industrial machinery such as liquid crystal display. In accordance with the above circumstance, demands of high-resolution have been increasing.

In the past, there have been known conventional inkjet heads described in the Patent Documents 1 and 2 (Unexamined Japanese Patent Application Publication Nos. H5-229128 and 2003-127359). The above inkjet heads are configured by forming a plurality of micro ink chambers and ink ejection ports on a silicon substrate. To form the ink chambers and the ink ejection ports, a manufacturing technology to manufacture semiconductor integrated circuit can be utilized, which enables to form patters of the ink chambers and the ink ejection ports having extremely minute pitches. Whereby, the demand of high-resolution can be satisfied.

In the inkjet head of Patent Document 1, the ink chambers and ink ejection ports are formed on an upper surface of the silicone substrate then by stacking and bonding a glass substrate having ink supply tubes thereon, the ink chambers are sealed, whereby the ink is supplied form the ink supply tube to each ink chamber. On an upper surface of the glass substrate, a piezoelectric element to eject the ink reserved in the ink chamber is bonded.

In the inkjet head of the Patent Document 2, the ink chambers and the ink ejection ports are formed on the upper surface of the silicon substrate, then by stacking and bonding a glass substrate having the ink supply tubes thereon, the ink chambers are sealed, whereby ink is supplied from the ink supply tube to each ink chamber. Onto a lower surface of the silicon substrate a glass substrate is bonded. In the glass substrate there is formed an electrode to eject ink reserved in the ink chamber using electrostatic force.

Patent Documents 1: Unexamined Japanese Patent Application Publication. No. H5-229128

Patent Documents 2: Unexamined Japanese Patent Application Publication. No. 2003-127359

DISCLOSURE OF THE INVENTION

Problems to be Solved by the Invention

In the inkjet head described in the Patent Documents 1 and 2, the silicon substrate and the glass tube are anodically-bonded without using an adhesive. Since the bonding surface is also a contact surface with the adhesive, there is a possibility that the adhesive is resoled by a solvent in the ink reserved in the ink chamber. In the Patent Document 1, a laminated structure configured with the silicon substrate and the glass substrate anodically-bonded in the above order from a bottom is possible and in the Patent Document 2 a laminated structure configured with the glass substrate, the silicon substrate and the glass substrate anodically-bonded in the above order from a bottom is possible. However, in both the cases, the ink supply tube to supply ink to the ink chamber has to be bonded with the glass substrate.

In the above cases, by using anodic bonding for bonding the ink supply tube and the glass substrate, use of the adhesive can be obviated however, to anodically bond the ink supply tube onto the glass substrate, the ink supply tube has to be formed with silicon. However, to form the ink supply tube with silicon, there are problems that sourcing and forming of raw materials in a shape of a tube are extremely difficult.

In the either of inkjet heads of Patent Documents 1 and 2, the ink ejection port and the ink chamber are formed by etching on the same silicon substrate, since they can readily hilted using the manufacturing technology of the semiconductor integrated circuit.

However, there is a problem of extremely low workability that application of a photoresist, exposing, developing and etching work have to be repeated a plurality of times to form the ink chamber and the ink ejection port, since the forming depths thereof are different.

Incidentally, there is known an electrostatic attraction type inkjet head, wherein an electric field is created between an opposite electrode to charge the ink in the head so as to attract and accelerate the ink ejected from the inkjet head. In such an inkjet head, the ink has to be in contact with a metal (electrode) so as to be charged.

However, in case of the inkjet heads of the Patent Documents 1 and 2, there is a problem of extremely low workability since patterning for complicated electrodes and wirings has to be carried out so as to dispose the electrodes in the ink chamber and ink flow path, and to connect them with outside of the head via wirings.

The present invention has one aspect to solve the above problems and objects of the present invention are to facilitate highly dense patterning of the ink chamber and the ink ejection port on the silicon substrate using the manufacturing technology of the semiconductor integrated circuit and to provide an inkjet head configured without using the adhesive at all portions which contact with ink.

Another subjects of the present invention, are to facilitate highly dense patterning of the ink chamber and the ink ejection port on a silicon substrate using the manufacturing technology of the semiconductor integrated circuit and to provide an electrostatic attraction type inkjet head configured without using an adhesive at all portions which contact with ink, wherein the ink in the inkjet head thereof can be charged readily.

Still another subject of the present invention will be clarified by the following descriptions.

Means to Solve the Problems

The above problems can be resolved by the followings.

1. An embodiment of item 1 is an inkjet head to eject ink in ink chambers from ink ejection ports by driving piezoelectric elements, having: a first silicon substrate in which a plurality of the ink ejection ports are formed to penetrate; a glass substrate bonded with one surface of the first silicon substrate, wherein a plurality of ink flow holes respectively corresponding to the ink ejection ports are formed to penetrate the glass substrate; and a second silicon substrate, wherein a plurality of the ink chambers respectively corresponding to ink flow paths are formed on one surface by grooving, the piezoelectric elements to change an inner volume of the ink chambers are disposed respectively on back sides of the ink chambers and an chamber forming surface is bonded with the glass substrate so as to face an opposite surface to the first silicon substrate, wherein, an ink flow channel to communicate with each ink chamber is formed on the ink chamber forming surface, a through hole to communicate with the ink flow channel is formed in the second silicon substrate, an ink flow tube configured with a glass tube is connected with the through hole, and bonding surfaces of the first silicon substrate, the glass substrate, the second silicon substrate and the ink flow tube are bonded by anodic-bonding.

2. An embodiment of item 2 is the inkjet head of item 1, wherein the ink flow tube is formed by a transparent glass tube.

3. An embodiment of item 3 is the inkjet head of item 1 or 2, wherein the ink flow tube is formed by a borosilicate glass tube.

4. An embodiment of item 4 is the inkjet head of any one of items 1 to 3, wherein there is further having an ink supply pathway from an ink supply tube to an ink flow out tube via the ink flow channel, wherein the through holes are formed at both ends of the ink flow channel, and the ink flow tube connected with one through hole represents the ink supply tube and the ink flow tube connected with the other through hole represent the ink flow out tube.

5. An embodiment of item 5 is the inkjet head of any one of items 1 to 4, wherein on an opposite surface of the second silicon substrate to the ink chamber forming surface, a reinforcing plate to give rigidity to the second silicon substrate is bonded.

6. An embodiment of item 6 is the inkjet head of any one of items 1 to 5, further comprising a heating device to heat an ink tube connected with the ink flow tube and ink supplied to the ink flow tube via the ink tube.

7. An embodiment of item 7 is an electrostatic attraction type inkjet head which attracts ejected ink form the inkjet head towards an opposite electrode by charging ink in the inkjet head by forming an electric field between the inkjet head and the opposite electrode facing the inkjet head, wherein a metal film is formed to cover a surface of the ink flow tube except the bonding surface with the second silicon substrate so that ink in the ink flow tube is charged via the metal film.

Effect of the Invention

According to the present invention, highly dense patterning of the ink chamber and the ink ejection port on a silicon substrate using the manufacturing technology of the semiconductor integrated circuit is facilitated and an inkjet head configured without using the adhesive at all portions to be in contact with ink is provided.

Also, according to the present invention, highly dense patterning of the ink chamber and the ink ejection port on a silicon substrate using the manufacturing technology of the semiconductor integrated circuit is facilitated and an electrostatic attraction type inkjet head configured without using the adhesive at all portions to be in contact with ink, in which the ink can be charged readily can be provided.

DESCRIPTION OF THE SYMBOLS

Figure 1:
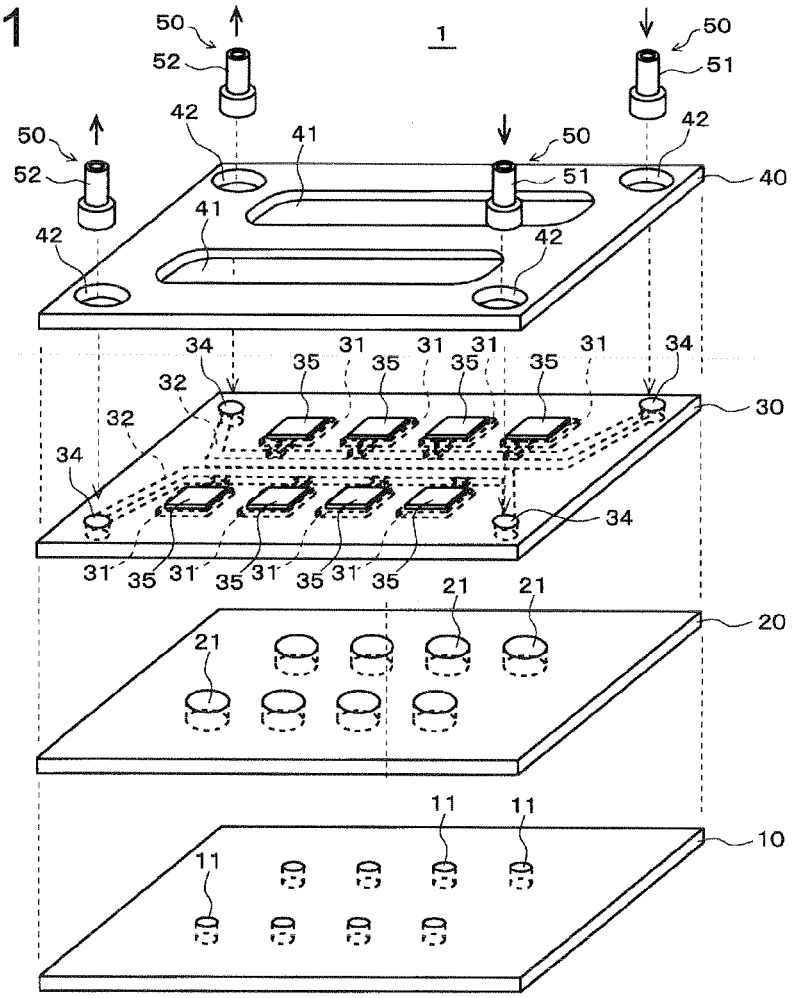
FIG. 1 is an exploded perspective view showing an exemplary inkjet head related to the present invention.

1, 100 and 200: Inkjet head
10: First silicon substrate
11: Ink ejection port
20: Glass substrate
21: Ink flow hole
30: Second silicon substrate
31: Ink chamber
31*a*: Vibration plate
32: Ink flow channel
33: Communication channel
34: Through hole
35: Piezoelectric element
40: Reinforcing plate
41: Opening section
42: Through hole
50: Ink flow tube
50*a*: Metal film
50*b*: Conductive member
51: Ink supply tube
52: Ink flow out tube
60: Ink tube
61: Discharging tube
62: Pump
70: Ink tank
80: Heating device
90: Opposite electrode
a: Ink droplet

DESCRIPTION OF THE PREFERRED EMBODIMENTS

Embodiments of the present invention will be described with reference to the drawings.

FIG. 1 is an exploded perspective view showing an exemplary inkjet head related to the present invention, wherein an inkjet head 1 is configured with a first silicon substrate 10, a glass substrate 20, a second silicon substrate 30 and a reinforcing plate 40 by laminating and bonding integrally in the above order from the bottom.

Figure 2:
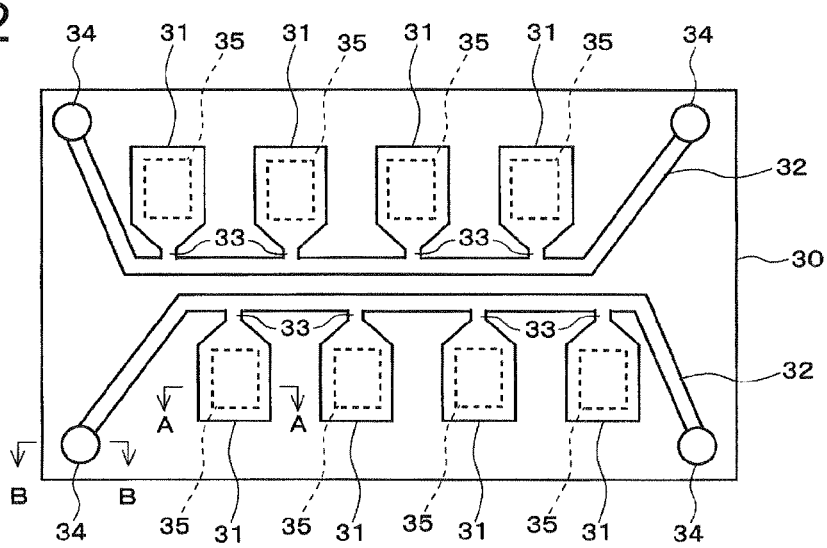
FIG. 2 is a view of a second silicon substrate observed from a bonding surface side with a glass substrate.
Figure 3:
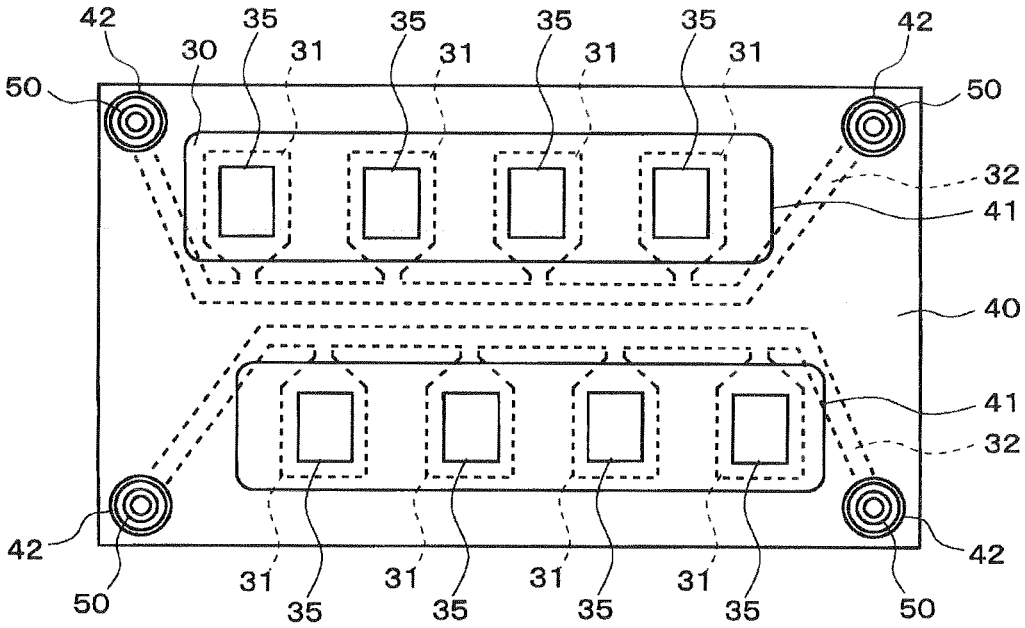
FIG. 3 is a plane view of an inkjet head related to the present invention.
Figure 4:
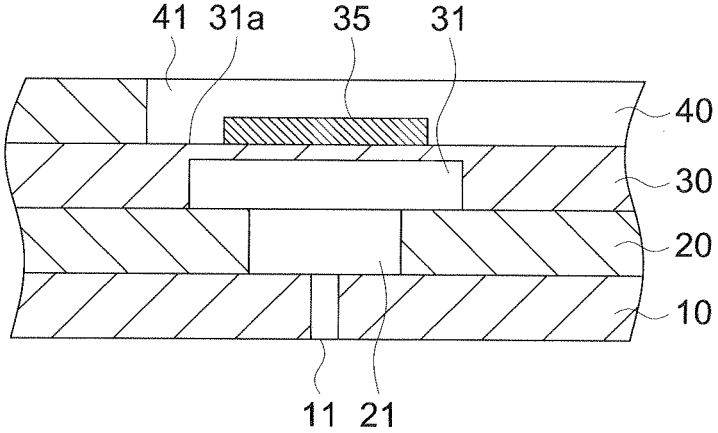
FIG. 4 is a cross sectional view showing a A-A line section in FIG. 2.
Figure 5:
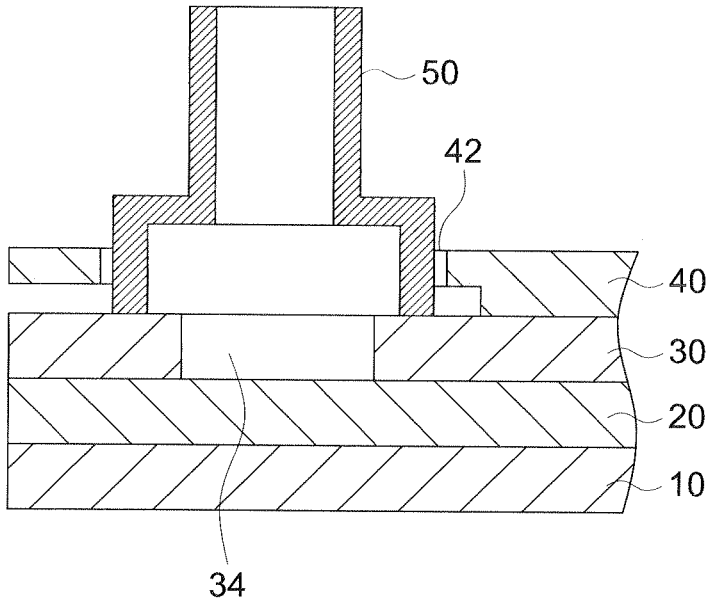
FIG. 5 is a cross sectional view showing a B-B line section in FIG. 2.

FIG. 2 is a view of a second silicon substrate 30 observed from a side of a bonding surface with a glass substrate, FIG. 3 is a plane view of an inkjet head 1, FIG. 4 is a cross sectional view of the inkjet head 1 showing a A-A line section in FIG. 2 and FIG. 5 is a cross sectional view of the inkjet head 1 showing a B-B line section in FIG. 2.

In the inkjet head 1, the first silicon substrate 10 located at a lower most layer is configured with, a for example, a silicon single crystal plate having a thickness of 200 to 500 μm in which a plurality of ink ejection ports 11 are formed to penetrate by dry etching. Here, while two rows where four ink ejection ports 11 are respectively disposed with a predetermined distance are formed in parallel each other, number of the ink ejection ports 11 in one row and number of the rows are not limited.

A diameter of the ink ejection port 11 is determined in accordance with size of the ink droplet to be ejected. According to the present invention, the diameter is preferred to be 4 to 10 μm, from a view point to satisfy demands of recent miniaturization in a high level since microfabrication is possible to be applied to the silicon single crystal plate using the manufacturing technology of the semiconductor integrated circuit.

The glass substrate 20 configured with, for example, a glass plate having a thickness of 100 to 300 μm is bonded onto an upper surface of the silicon substrate 10. On the glass substrate 20, an ink flow hole 21 having the diameter larger than that of the ink ejection port 11 is formed to penetrate at a position corresponding to each ink ejection port 11 of the first silicon substrate 10.

The ink flow hole 21 is a flow path to smoothly flow the ink in the ink chamber to be described toward the ink ejection port 11 of the first silicon substrate 10. A diameter of the ink flow hole 21 is preferred to be 0.1 to 2 mm.

A second silicon substrate 30 configured with a silicon single crystal plate having a thickness of 200 to 500 μm is bonded with an upper surface of the glass substrate 20. The second silicon substrate 30 is preferred to have the same thickness and the same shape as that of the first silicon substrate 10 from a view point to prevent occurrence of bending caused by temperature increase at the time of anodic-bonding.

The bonding surface side with the glass substrate 20 of the second silicon substrate 30, is grooved by dry etching at positions corresponding to the plurality of the ink flow holes 21 of the glass substrate 20, to form the ink chambers 31. Also the bonding surface thereof is grooved by dry etching to form two ink flow channels 32 which commonly supply ink to each ink chamber 31 of each row. Each ink chamber 31 and each ink flow channel 32 are connected via a communication channel 33 so as to enable ink from the ink flow channel 32 to flow into the ink chamber 31. Further, both ends of each the ink flow channel 32 extend from both ends of the row of each ink channel 31 to vicinities of four corners of the second silicon substrate 30 so as to communicate with insides of the through holes 34 respectively framed at the vicinities of four corners.

Each ink chamber 31, having a larger area of opening than that of the ink flow hole 21 formed on the glass substrate 20, is formed by recessing the bonding surface of the second silicon substrate 30 with the glass substrate 20 by a predetermined depth from the bonding surface thereof. Piezoelectric elements 35 are individually bonded on a back surface side of each ink chamber 31, namely a surface of the second silicon substrate 30 on the side opposite to the bonding surface with the glass substrate 20. By electric-mechanical conversion of the piezoelectric element 35, a bottom surface of each ink chamber 31 is vibrated and an inner volume of the ink chamber 31 is changed so as to apply ejection energy to the ink in the ink chamber 31. The ink in the ink chamber 31, to which the ejection energy is applied by driving of the piezoelectric element 35, is ejected downward in the figure from the ink ejection port 11 via the ink flow hole 21.

As above, the bottom surface of each ink chamber serves as a vibration plate 31*a*. Thus, a depth is adjusted when the second silicon substrate 30 is grooved to form each ink chamber 31 by etching so that the thickness of the bottom surface of each ink chamber 31 becomes preferably 1 to 20 μm.

The reinforcing plate 40 gives rigidity to the second silicon substrate 30 and suppresses vibration of the second silicon substrate 30 as a whole when the vibration plate 31*a* is vibrated by the piezoelectric element 35, whereby the reinforcing plate 40 realizes to vibrate the vibration plate 31*a* efficiently through electric-mechanical conversion of the piezoelectric element 35. The reinforcing plate 40 configured with, for example, metal plate such as stainless steel, a kovar alloy (low thermal expansion material, Ni-based alloy) and an aluminum alloy is bonded onto the upper surface of the second silicon substrate 30 using an adhesive.

On the reinforcing plate 40, opening sections 41 in two rows are formed. The piezoelectric element 35 bonded on the second silicon substrate 30 are exposed through the opening sections 41 to an upper surface. Through the opening sections 41, wiring (unillustrated) such as FPC is connected to each piezoelectric element.

At the vicinities of the four comers of the reinforcing plate 40, through holes 42 are formed respectively at positions corresponding to the through holes 34 formed on the second silicon substrate 30. Through the through holes 42, ink flow tubes 50 are connected respectively with the through holes 34 of the second silicon substrate 30. In the present invention, the glass substrate 20 is interposed between the first silicon substrate 10 in which the ink ejection port 11 is formed by microfabrication and the second silicon substrate 30 in which the ink chamber 31 is formed by microfabrication so as to seal the ink chamber 31 recessed in the second silicon substrate 30. Owing to the above configuration, the ink flow tube 50 to supply ink to each ink chamber 31 can be connected with the second silicon substrate 30. Whereby, each ink flow tube 50 is formed with a glass tube capable of anodic bonding with the second silicon substrate 30 as described later.

Each ink flow tube 50 and the reinforcing plate 40 are not in contact, and an inside of each ink flow tube 50 is communicated with the through hole 34 of the second silicone substrate 30. Here, an end of each ink flow tube 50 communicating with each through hole 34 at both ends of the ink flow channel 32 serves as an ink supply tube 51, and other end of each ink flow tube 50 serves as an ink flow out tube 52, therefore, an ink supply path from the ink supply tube 51 to an ink flow out tube 52 via the ink flow channel 32 is formed. Forming of the ink supply path as above can facilitate ink filling job, which is a preferable embodiment.

It is preferable to use a transparent glass tube, since entering of an air bubble which obstructs ink ejection can be observed at a portion of the ink flow tube 50.

Also, it is preferable to use a borosilicate glass tube as the ink flow tube 50, since the borosilicate glass in the tube shape can be obtained easily and is relatively inexpensive.

In the above inkjet head 1, bonding between the first silicon substrate 10 and the glass substrate 20, bonding between the glass substrate 20 and the second silicon substrate 30, and bonding between the second silicon substrate 30 and the ink flow tube 50 can be performed by anodic-bonding without using the adhesive. Anodic-bonding is performed in a way that silicon and glass at each bonding surface is heated up to 200 to 500° C. to soften the glass, and at the same time, by applying a high voltage to the silicon side as a cathode and the glass side as an anode so as to create an electrical double layer, the bonding surfaces are contacted and bonded by an electrostatic attraction force.

In the present invention, while the above bonding surfaces are contact surfaces with ink, by bonding the above bonding surfaces by anodic-bonding, a highly reliable bonding where possibility of being resolved by an ink solvent is eliminated can be performed, because the adhesive does not exist in all portions in contact with ink.

Also, since both the ink ejection port 11 and the ink chamber 31 which are required high miniaturization can be formed on the silicon substrates 10 and 30, fine and dense pattern forming using the manufacturing technology of the semiconductor integrated circuit is possible.

Further, only simple through holes are formed on the first silicon substrate 10 and the glass substrate 20, and ink ejection port does not have to be formed along with the ink chamber 31 on the second silicon substrate 30, forming work at dry etching is extremely simple.

Figure 6:
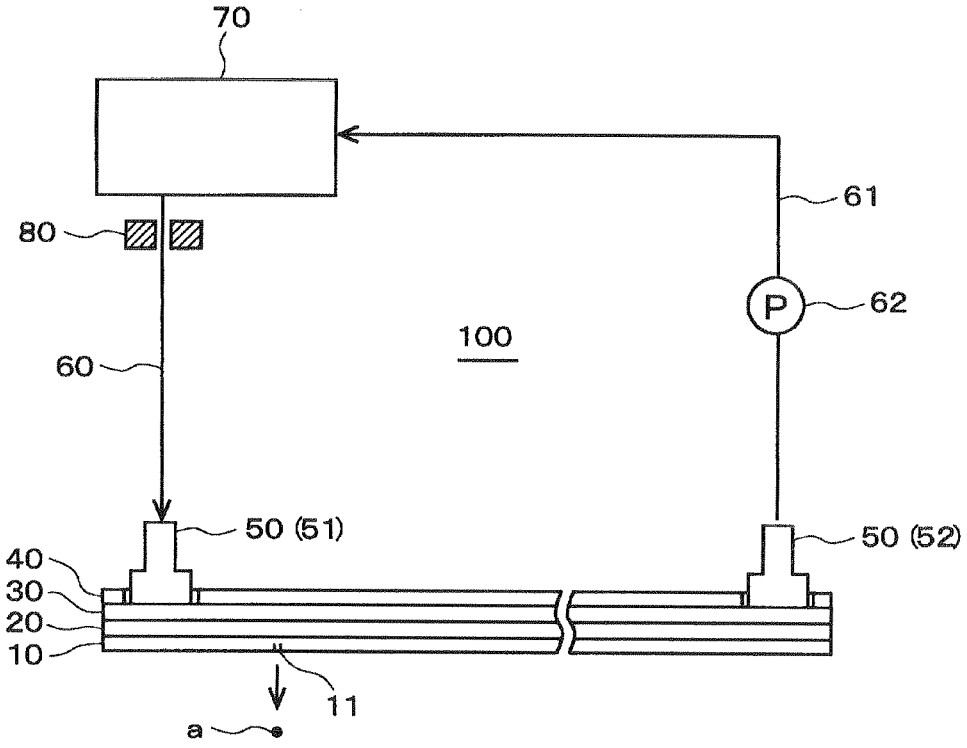
FIG. 6 is a configuration diagram showing another embodiment of the inkjet head related to the present invention.

FIG. 6 shows another embodiment of the inkjet head related to the present invention. Since the portions denoted by the same symbols as in FIG. 1 have the same structure, detailed descriptions thereof are omitted.

In the inkjet head 100, an ink tube 60 is connected with an ink flow tube 50 to supply ink in an ink tank 70 to the ink flow tube 50 via the ink tube 60. A numeral symbol 80 denotes a heating device (heater) to heat ink supplied from an ink tank 70 to the ink flow tube 50.

Figure 7:
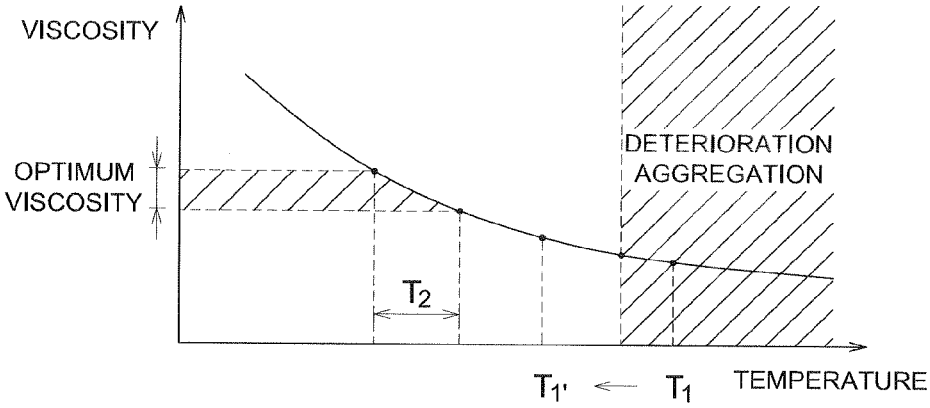
FIG. 7 is a graph showing a relationship between ink temperature and ink viscosity.

As above, in case the ink to be supplied to the head is heated by the heating device 80, a temperature of the heating device 80 is set so that a viscosity of an ink droplet ejected from the ink ejection port 11 becomes an optimum viscosity. Namely, as FIG. 7 shows, in case the temperature, where the viscosity of the ink droplet ejected from the ink ejection port 11 is the optimum viscosity, is in the range of $T_2$° C., a temperature of the heating device 80 is set higher than $T_2$° C. considering temperature decreasing due to heat radiation while ink is supplied via the ink tube 60 and the ink flow tube 50. Here, provided that the ink flow tube 50 is formed of a metal material such as a stainless steel, because of high coefficient of thermal conductivity, large radiation of heat occurs, thus the setting temperature of the heating device 80 has to be a higher temperature of $T_1$° C. which may reach the temperature range where deterioration and coagulation of ink possibly occur.

Contrarily, in the present invention since the glass tube having a lower coefficient of thermal conductivity than that of the metal material is utilized for the ink flow tube 50, the radiation of heat in the above portion can be suppressed to a low level. Whereby, the setting temperature of the heating device 80 can be set at $T_1'$° C. which is lower than $T_1$° C. so as to reduce the possibility that the temperature reaches the temperature range where deterioration and coagulation of the ink may occur.

Also, as above, in case the ink flow tube 50 forms the ink supply path which is separated into the ink supply tube 51 and the ink flow out tube 52, as FIG. 6 shows, the ink discharged from the ink flow out tube 52 can be returned to the ink tank 70 via discharging tube 61 by driving a pump 62. Thus, ink heated to the optimum temperature by the healing device 80 can be supplied to the head again from the ink tank 70, and ink of which temperature has been decreased while the ink is staying inside the head for a long time cannot be ejected. Thus, control of ink temperature and viscosity is facilitated and there is a merit that high-resolution recording can be maintained by always ejecting the ink droplet a having an optimum viscosity.

Figure 8:
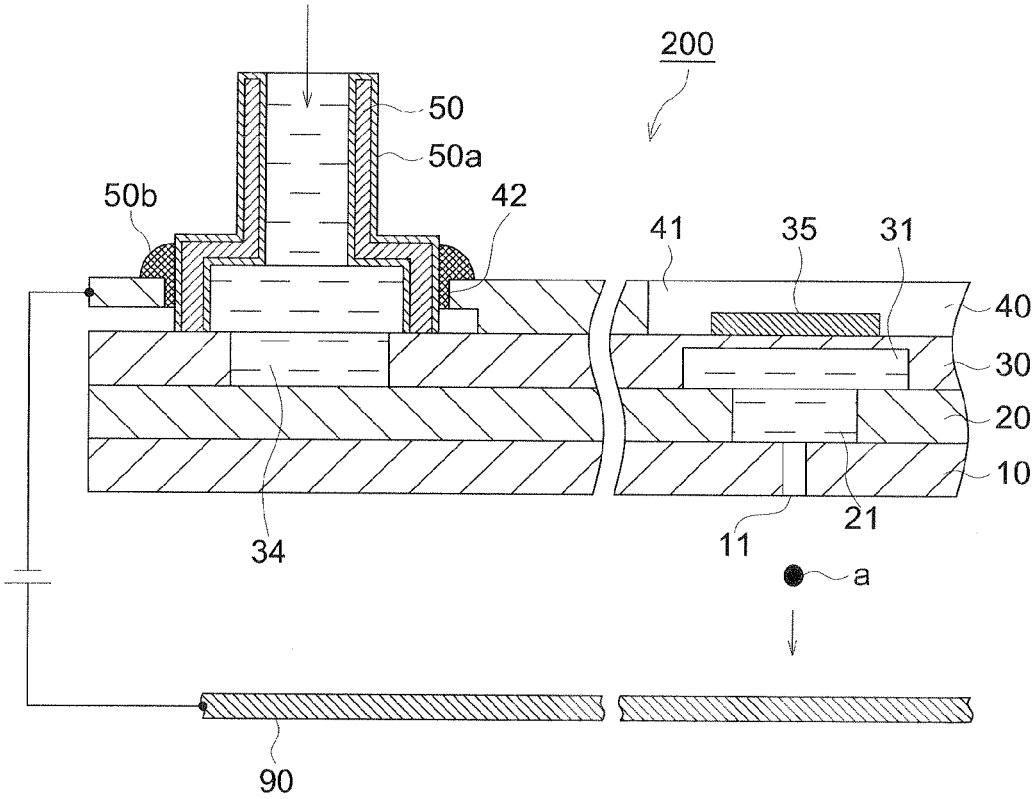
FIG. 8 is a partial cross-sectional view showing another embodiment of an inkjet head related to the present invention.

FIG. 8 is still another embodiment of an inkjet head related to the present invention. Since the portions denoted by the same symbols as in FIG. 1 have the same structure, detailed descriptions thereof are omitted.

The inkjet head 200 is an example of electrostatic attraction type ink jet head wherein an electric field is formed between the opposite electrode 90 disposed to oppose to the ink ejection port 11, and a charged ink droplet a ejected from the ink ejection port 11 is attracted toward the opposite electrode 90, and is landed on a recording medium (unillustrated) disposed between the ink ejection port 11 and the opposite electrode 90. In the above electrostatic attraction type inkjet head, in order to charge the ink, ink contacts with the electrode so as to be applied a predetermined voltage, however, since the inkjet head related to the present invention metal material is not used at portions in contact with ink from the ink flow tube 50 to the ink ejection port 11, charging of ink is difficult.

In the present invention, in the ink flow tube 50, metal films **50*a* are formed on an outer circumferential surface and an external circumferential surface of the ink flow tube 50 and an upper surface connecting the outer circumferential surface and the external circumferential surface so as to cover the surfaces thereof except a connecting surface with the second silicon substrate 30**.

The metal film **50*a* is formed through vapor deposition or spattering using, for example, Al, Ni. Cu and Au as materials of vapor deposition. The metal film 50*a* is preferred to be formed by masking portions except the ink flow tube 50 before bonding the reinforcing plate 40 and after bonding the ink flow tube 50 onto the second silicon substrate 30. Whereby, ink flowing in the ink flow tube 50 contacts with metal film 50*a* and the ink can be charged via the metal film 50*a* thus an electric field can be formed between the opposite electrode 90** easily.

The ink can be charged by applying voltage directly to the metal film **50*a*. Or, in case an inkjet head having a plurality of rows of a plurality of ink ejection ports 11, it is preferred that the metal film 50*a* and the reinforcing plate 40 are conducted by filling a gap formed between the ink flow tube 50 and the through holes 42 in the reinforcing plate 40 as FIG. 8 shows, since a plurality of the ink flow tubes 50 are also disposed. Whereby, by applying voltage onto the opposite electrode 90 and the reinforcing plate 40, the voltage can be applied to the metal films 50*a* in all the ink flow tubes 50**.

What is claimed is:

1. An inkjet head to eject ink in ink chambers from ink ejection ports by driving piezoelectric elements, comprising:

a first silicon substrate in which a plurality of the ink ejection ports are formed to penetrate;

a glass substrate bonded with one surface of the first silicon substrate, wherein a plurality of ink flow holes respectively corresponding to the ink ejection ports are formed to penetrate the glass substrate; and a second silicon substrate, wherein a plurality of the ink chambers respectively corresponding to ink flow paths are formed on an ink chamber forming surface of the second silicon substrate by grooving, wherein the piezoelectric elements, which change an inner volume of the ink chambers, are disposed respectively on back sides of the ink chambers, and wherein the ink chamber forming surface is bonded with the glass substrate so as to face an opposite surface of the glass substrate from the first silicon substrate; and an ink supply pathway from an ink supply tube to an ink flow out tube via an ink flow channel, wherein through holes are formed at both ends of the ink flow channel, and ink flow tubes are connected with the through holes, wherein the ink flow tube connected with one of the through holes serves as the ink supply tube, and wherein the ink flow tube connected with the other of the through holes serves as the ink flow out tube, wherein:

the ink flow channel communicates with each ink chamber and is formed on the ink chamber forming surface, the through holes communicating with the ink flow channel are formed in the second silicon substrate, the ink flow tubes connected with the through holes are glass ink flow tubes, and bonding surfaces of the first silicon substrate, the glass substrate, the second silicon substrate, and the ink flow tubes are bonded by anodic-bonding.

2. The inkjet head of claim 1, wherein the ink flow tube is a transparent glass tube.

3. The inkjet head of claim 1, wherein the ink flow tube is a borosilicate glass tube.

4. An inkjet head to eject ink in ink chambers from ink ejection ports by driving piezoelectric elements, comprising:

a first silicon substrate in which a plurality of the ink ejection ports are formed to penetrate;

a glass substrate bonded with one surface of the first silicon substrate, wherein a plurality of ink flow holes respectively corresponding to the ink ejection ports are formed to penetrate the glass substrate;

a second silicon substrate, wherein a plurality of the ink chambers respectively corresponding to ink flow paths are formed on an ink chamber forming surface of the second silicon substrate by grooving, wherein the piezoelectric elements, which change an inner volume of the ink chambers, are disposed respectively on back sides of the ink chambers, and wherein the ink chamber forming surface is bonded with the glass substrate so as to face an opposite surface of the glass substrate from the first silicon substrate; and a reinforcing plate to give rigidity to the second silicon substrate, the reinforcing plate being bonded on an opposite surface of the second silicon substrate to the ink chamber forming surface, wherein:

an ink flow channel to communicate with each ink chamber is formed on the ink chamber forming surface, a through hole to communicate with the ink flow channel is formed in the second silicon substrate, a glass ink flow tube is connected with the through hole, and bonding surfaces of the first silicon substrate, the glass substrate, the second silicon substrate, and the ink flow tube are bonded by anodic-bonding.

5. The inkjet head of claim 4, wherein the ink flow tube a transparent glass tube.

6. The inkjet head of claim 5, wherein the ink flow tube is a borosilicate glass tube.

7. The type inkjet head of claim 4, wherein the inkjet head is an electrostatic attraction ink jet head which attracts ejected ink from the inkjet head towards an opposite electrode by charging ink in the inkjet head and by forming an electric field between the inkjet head and the opposite electrode facing the inkjet head, wherein a metal film is formed to cover a surface of the ink flow tube excluding the bonding surface of the flow tube to be bonded to the second silicon substrate to charge ink in the ink flow tube via the metal film.

8. An inkjet head to eject ink in ink chambers from ink ejection ports by driving piezoelectric elements, comprising:

a first silicon substrate in which a plurality of the ink ejection ports are formed to penetrate;

a glass substrate bonded with one surface of the first silicon substrate, wherein a plurality of ink flow holes respectively corresponding to the ink ejection ports are formed to penetrate the glass substrate;

a second silicon substrate, wherein a plurality of the ink chambers respectively corresponding to ink flow paths are formed on an ink chamber forming surface of the second silicon substrate by grooving, wherein the piezoelectric elements, which change an inner volume of the ink chambers, are disposed respectively on back sides of the ink chambers, and wherein the ink chamber forming surface is bonded with the glass substrate so as to face an opposite surface of the glass substrate from the first silicon substrate, and wherein:

an ink flow channel to communicate with each ink chamber is formed on the ink chamber forming surface, a through hole to communicate with the ink flow channel is formed in the second silicon substrate, a glass ink flow tube is connected with the through hole, and bonding surfaces of the first silicon substrate, the glass substrate, the second silicon substrate, and the ink flow tube are bonded by anodic-bonding, and wherein the inkjet head further comprises a heating device to heat an ink tube connected with the ink flow tube and ink supplied to the ink flow tube via the ink tube.

9. The inkjet head of claim 8, wherein the ink flow tube is a transparent glass tube.

10. The inkjet head of claim 9, wherein the ink flow tube is a borosilicate glass tube.

11. The type inkjet head of claim 8, wherein the inkjet head is an electrostatic attraction ink jet head which attracts ejected ink from the inkjet head towards an opposite electrode by charging ink in the inkjet head and by forming an electric field between the inkjet head and the opposite electrode facing the inkjet head, wherein a metal film is formed to cover a surface of the ink flow tube excluding the bonding surface of the flow tube to be bonded to the second silicon substrate to charge ink in the ink flow tube via the metal film.

* * * * *